US005936348A

United States Patent [19]

Shimoi et al.

[11] Patent Number: 5,936,348

[45] Date of Patent: Aug. 10, 1999

[54] PHOTOMULTIPLIER TUBE WITH FOCUSING ELECTRODE PLATE

[75] Inventors: Hideki Shimoi; Hiroyuki Kyushima; Shinichi Muramatsu; Eiichiro Kawano, all of Hamamatsu, Japan

[73] Assignee: Hamamatsu Photonics K.K., Hamamatsu, Japan

[21] Appl. No.: 08/955,462

[22] Filed: Oct. 21, 1997

[51] Int. Cl.[6] ..... H01J 43/06

[52] U.S. Cl. ..... 313/533; 313/534; 313/541; 313/103 CM

[58] Field of Search ..... 313/532, 533, 313/534, 540, 541, 542, 544, 103 R, 103 CM, 104, 105 R, 105 CM; 250/214 VT, 207

[56] References Cited

U.S. PATENT DOCUMENTS

| | | | |
|---|---|---|---|
| 4,816,718 | 3/1989 | Lavoute et al. | 313/534 |
| 4,881,008 | 11/1989 | Kyushima et al. | 313/532 |
| 4,937,506 | 6/1990 | Kimura et al. | 313/533 |
| 5,180,943 | 1/1993 | Kyushima | 313/535 |
| 5,410,211 | 4/1995 | Kyushima | 313/103 R |
| 5,416,382 | 5/1995 | L'Hermite | 313/532 |
| 5,481,158 | 1/1996 | Kato et al. | 313/533 |
| 5,504,386 | 4/1996 | Kyushima et al. | 313/103 R |
| 5,532,551 | 7/1996 | Kyushima et al. | 313/533 |
| 5,689,152 | 11/1997 | Boutot et al. | 313/532 |

FOREIGN PATENT DOCUMENTS

| | | | |
|---|---|---|---|
| A-6-314550 | 11/1994 | Japan | H01J 43/12 |
| 2 268 623 | 1/1994 | United Kingdom | H01J 43/04 |
| 2 300 513 | 11/1996 | United Kingdom | H01J 43/04 |

*Primary Examiner*—Sandra O'Shea
*Assistant Examiner*—Michael Day
*Attorney, Agent, or Firm*—Oliff & Berridge, PLC

[57] ABSTRACT

In the electron multiplier assembly 27, a dynode unit 10 is constructed from a plurality of dynodes 9 laminated one on another. Each dynode 9 is formed with multichannels 12 which are separated from one another by channel-separating portions 14. A focusing electrode plate 16 is formed with multichannels 18 which are separated from one another by channel-separating electrodes 20 which are located in correspondence with the channel-separating portions 14 of the first stage dynode 9*a*. A plurality of anodes 7 are provided for receiving electrons multiplied at the dynode unit 10 in their corresponding channels 18. Each channel-separating electrode 20 is formed with an opening 21, at a position confronting the channel-separating portion 14 of the first stage dynode 9*a*, for transmitting electrons therethrough.

9 Claims, 10 Drawing Sheets

PHOTOMULTIPLIER TUBE WITH FOCUSING ELECTRODE PLATE

BACKGROUND OF THE INVENTION

1. Field of the Invention

The present invention relates to an electron multiplier and a photomultiplier tube. More particularly, the present invention relates to an electron multiplier and a photomultiplier tube provided with a focusing electrode plate.

2. Description of Related Art

U.S. Pat. No. 5,504,386 discloses a photomultiplier tube of a multianode type. The photomultiplier tube includes a faceplate for receiving light. The faceplate is provided with a photocathode for converting the light into photoelectrons. A focusing electrode plate is located below the photocathode. A dynode unit and an anode unit are located in this order below the focusing electrode plate. The anode unit has a two-dimensionally arranged plurality of anodes.

The dynode unit is constructed from a plurality of dynode plates stacked one on another. The plurality of dynode plates include a first stage dynode plate that is located in the uppermost position of the dynode unit. Each dynode plate is formed with a plurality of channels. Each channel is constructed from one or more through-holes for multiplying incident electrons. It is noted that the plurality of channels are separated from one another with channel-separating portions. Each channel-separating portion has no through-holes, but has upper and lower surfaces.

In correspondence with the multi-channel structure, the focusing electrode plate is provided with a two-dimensionally arranged plurality of channel openings. That is, the focusing electrode plate is formed with a frame supporting a plurality of electrodes arranged in a grid pattern. The plurality of channels are separated from one another by the grid electrodes. Each grid electrode is located just above a corresponding channel-separating portion of the first stage dynode plate. Accordingly, the plurality of channel openings of the focusing electrode plate are located in confrontation with the plurality of channels of the first stage dynode plate. Each channel opening is for receiving electrons emitted from a corresponding position on the photocathode and for guiding the electrons to the corresponding channel in the dynode unit.

In the focusing electrode plate, an electric potential distribution is developed in each channel opening due to an electric potential of the grid electrodes surrounding the subject channel opening. The electric potential distribution guides the electrons from the corresponding position on the photocathode to the corresponding channel of the dynode unit. In the dynode channel, the electrons are successively multiplied and are finally collected at the corresponding anode. Thus, position-dependent detection can be attained on the light falling incident on the photocathode.

SUMMARY OF THE INVENTION

It is noted that the width of each grid electrode is much smaller than that of the corresponding channel-separating portion of the first stage dynode plate. Accordingly, some photoelectrons, that are emitted from the photocathode in a direction toward an edge of the channel, are attracted toward the channel-separating portion of the first stage dynode. Those photoelectrons are trapped by the channel-separating portion. Accordingly, the number of photoelectrons falling incident on each channel is reduced. This leads to decrease in the total number of photoelectrons detected at each anode.

The photomultiplier tube may not output signals for a contour portion of each channel, and therefore has a deteriorated uniformity over each channel.

In order to solve this problem, it is conceivable to increase the width of the grid electrode. In this case, it is possible to decrease the number of photoelectrons that are attracted to and trapped by the channel-separating portion. It is possible to allow photoelectrons to properly fall incident on each channel. It is possible to prevent decrease in the total number of photoelectrons detected at each anode. The photomultiplier tube can provide signals also for each channel contour portion. Uniformity over each channel can be enhanced.

In this case, however, the grid electrode has a great surface area, and therefore distorts the electric potential distribution around the grid electrode. Thus distorted electric potential distribution largely deflects photoelectrons from the photocathode, and guides them to undesired channels of the first stage dynode plate. This results in increase of crosstalk between the respective channels.

The present invention is attained to solve the above-described problems. An object of the present invention is therefore to provide an electron multiplier and a photomultiplier tube which can provide signals with suppressed crosstalk and with enhanced uniformity.

In order to attain the above and other objects, the present invention provides an electron multiplier, comprising: a dynode unit constructed from a plurality of dynodes laminated one on another, the plurality of dynodes including a first dynode and subsequent dynodes, each dynode having a plurality of channels each for multiplying electrons, the plurality of channels being separated from one another by a channel-separating portion; a focusing electrode plate located confronting the first dynode and having a plurality of channels each for guiding electrons to a corresponding channel of the first dynode, the plurality of channels being separated from one another by a channel-separating electrode which is located in correspondence with the channel-separating portion of the first dynode, the channel-separating electrode having an opening, at a position confronting the channel-separating portion of the first dynode, for transmitting electrons therethrough and for guiding the electrons to the channel-separating portion of the first dynode; and an anode unit for receiving electrons multiplied at the plurality of channels in the dynode unit. The width of the opening formed in the channel-separating electrode may be set smaller than a width of the channel-separating portion of the dynode unit.

BRIEF DESCRIPTION OF THE DRAWINGS

The above and other objects, features and advantages of the invention will become more apparent from reading the following description of the preferred embodiment taken in connection with the accompanying drawings in which:

FIG. 3(*b*) illustrates a dimensional relationship between electrodes 22 and an opening 21 formed therebetween;

DETAILED DESCRIPTION OF THE PREFERRED EMBODIMENT

Figure 1:
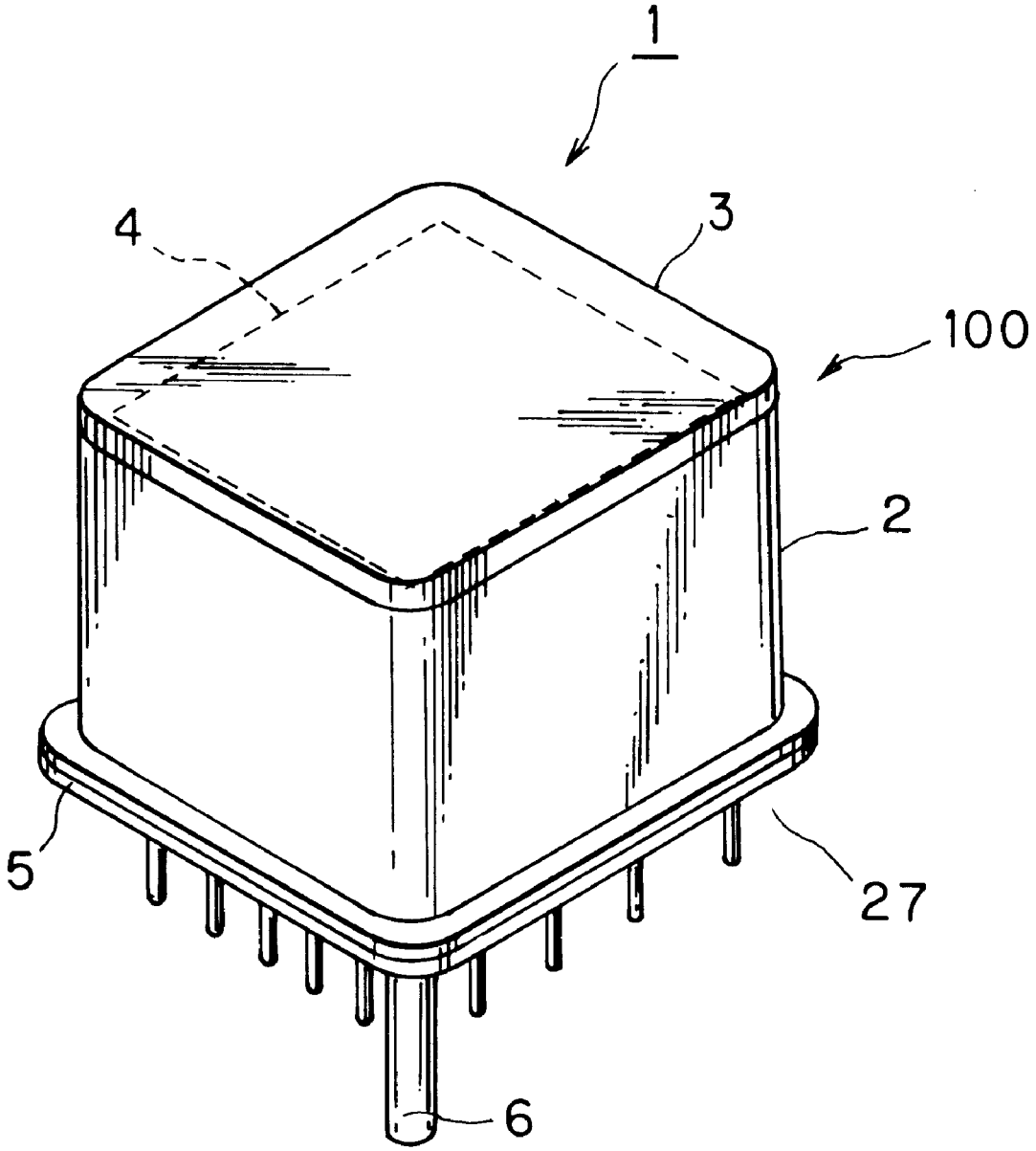
FIG. 1 is a perspective view of a photomultiplier tube of an embodiment of the present invention.

A photomultiplier tube according to a preferred embodiment of the present invention will be described while referring to the accompanying drawings wherein like parts and components are designated by the same reference numerals.

Directional terms, such as up and down, will be used in the following description with reference to the state of the photomultiplier tube 1 located in an orientation shown in FIG. 1.

FIG. 1 is a perspective external view showing a box-shaped photomultiplier tube 1 of the present embodiment. As apparent from the figure, the photomultiplier tube 1 has an evacuated envelope 100 having a generally square-shaped faceplate 3, a generally cylindrical metal sidewall 2 having a square cross-section, and a generally square-shaped stem 5. The square-shaped faceplate 3 is sealingly attached to one open end (upper open end) of the cylindrical sidewall 2. That is, the square-shaped faceplate 3 is airtight welded to the upper open end of the square-cylindrical metal sidewall 2. The faceplate 3 is made of glass. A photocathode 4 is formed on the interior surface of the faceplate 3. The photocathode 4 is for converting incident light into photoelectrons. The stem 5 is sealingly attached to the other open end (lower open end) of the square-cylindrical sidewall 2.

Figure 2:
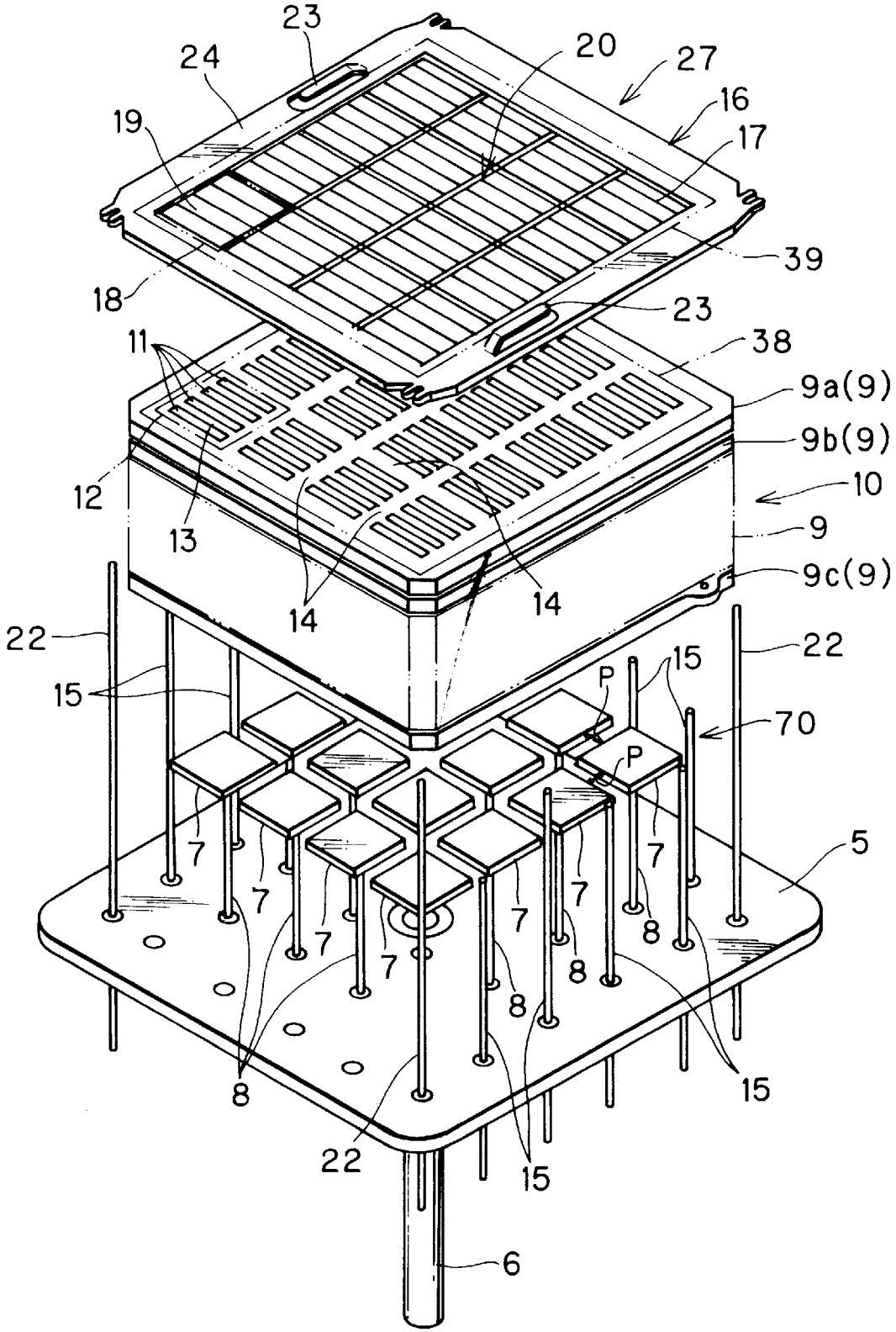
FIG. 2 is an exploded perspective view showing the inside of the photomultiplier tube of FIG. 2.

Inside the envelope 100 is provided an electron multiplier assembly 27, shown in FIG. 2, for multiplying the photoelectrons emitted from the photocathode 4.

The multiplier assembly 27 includes: a plate-shaped focusing electrode 16; a block-shaped dynode unit 10; and a multi-anode unit 70. The multi-anode unit 70 includes sixteen anode plates 7 which are arranged in a two-dimensional, four by four matrix form. The anode plates 7 are separated from one another by a fixed amount of inter-anode distance P.

The dynode unit 10 is constructed from eight stages of dynode plates 9 which are arranged as stacked one on another. The eight stages of dynode plates 9 include a first stage dynode plate 9*a* in the uppermost position and a second stage dynode plate 9*b* just below the first stage dynode plate 9*a*. Each stage of dynode plate 11 is designed to have sixteen electron multiplication channels 12 which are arranged also in the two-dimensional matrix form in correspondence with the sixteen anode plates 7. That is, the sixteen electron multiplication channels 12 are arranged in a four by four matrix, and are separated from one another by the inter-anode distance P.

The stem 5 is a generally square-shaped metal plate. A metal exhaust tube 6 is provided in the center of the stem 5 to protrude vertically downward. Sixteen anode pins 8 are provided also extending vertically through the stem 5 to support the respective anode plates 7 while supplying predetermined voltages thereto. Sixteen dynode pins 15 are provided also extending vertically through the stem 5 to support the respective dynode plates 9 while supplying predetermined voltages thereto. Four focusing electrode pins 22 are provided also extending vertically through the stem 5 to support the focusing electrode plate 16 while supplying predetermined voltages thereto.

Those pins 8, 15, and 22 are connected to an electric source (not shown) so that the anode plates 7, the respective dynode plates 9, and the focusing electrode plate 16 are supplied with predetermined electric voltages. The dynode unit 10 and the anode plates 7 are supplied with predetermined electric voltages so that the dynode unit 10 has an electric potential lower than that of the anode plates 7. The respective stage dynode plates 9 in the dynode unit 10 are supplied with predetermined voltages so that the dynodes of the respective stages have gradually increased potentials toward the anode plates 7. The focusing electrode plate 16 is supplied with an electric voltage so as to have an electric potential lower than that of the first stage dynode plate 9*a* in the dynode unit 10.

Figure 4:
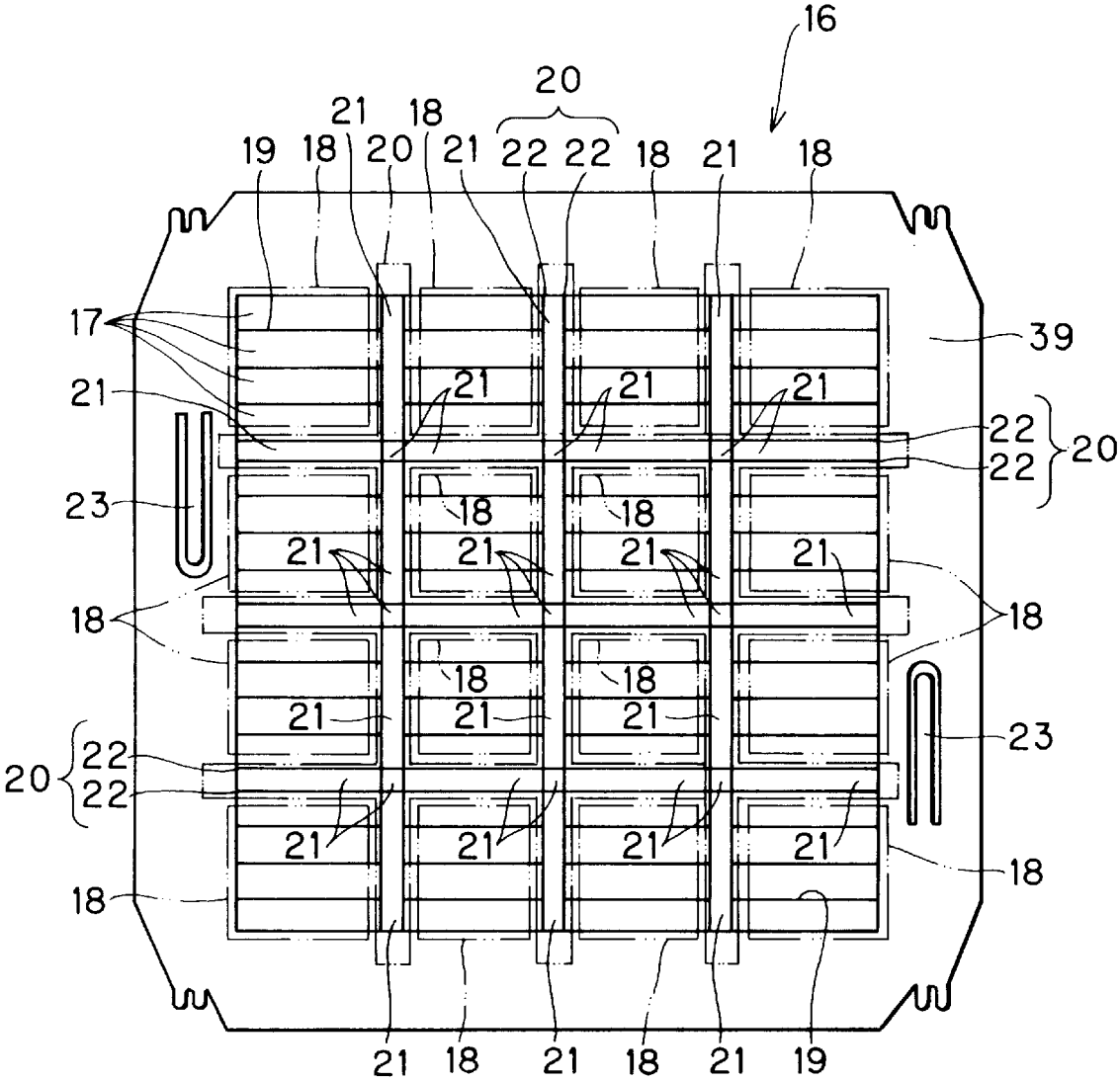
FIG. 4 is a plan view of the focusing electrode plate of FIG. 2.

As shown in FIGS. 2 and 4, a pair of pins 23 are provided to the focusing electrode plate 16. The pair of pins 23 are for being contacted with the photocathode 4 when the multiplier assembly 27 is mounted in the envelope 100. The pair of pins 23 are for allowing the photocathode 4 to have the same electric potential with the focusing electrode plate 16, which is supplied with the predetermined electric voltage via the pins 22.

The structure of the electron multiplier assembly 27 will be described in greater detail below.

Figure 6:
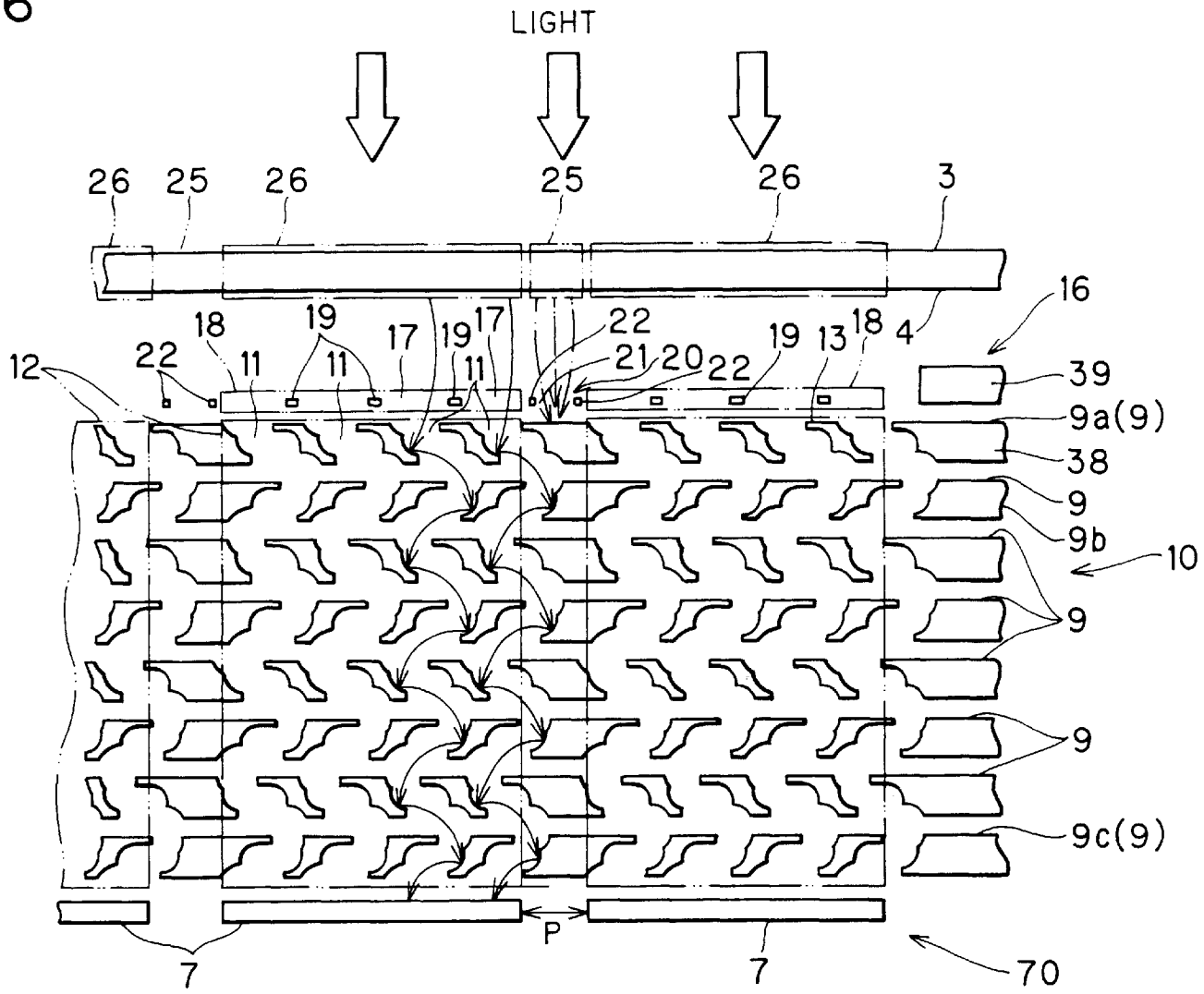
FIG. 6 is a sectional view taken along a line VI—VI of FIG. 5.

As described above, the multi-anode unit 70 is constructed from the sixteen anode plates 7, which are arranged in the four by four matrix. As shown in FIG. 6, each adjacent pair of anode plates 7 are separated from each other with the fixed amount of gap P therebetween.

Figure 3A:
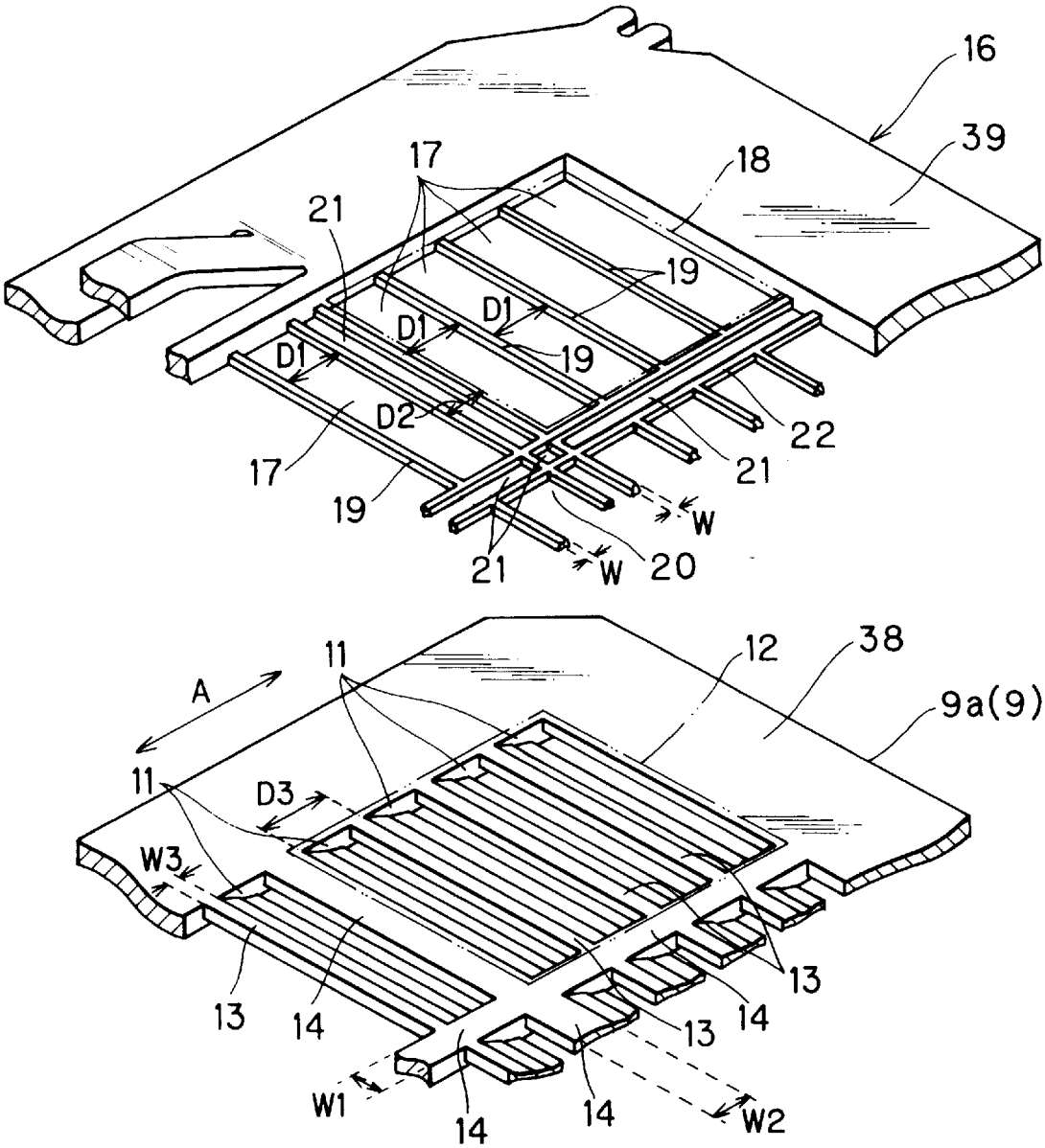
FIG. 3(*a*) is an enlarged perspective view of a part of a focusing electrode plate and a part of a first stage dynode plate.
Figure 3B:
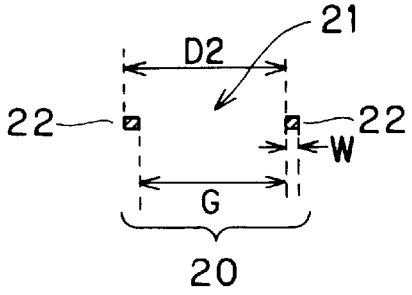

Each stage dynode plate 9 in the dynode unit 10 is electrically-conductive and has upper and lower surfaces. Each dynode plate 9 has a frame portion 38 surrounding the sixteen channels 12. As shown in FIGS. 2 and 3(*a*), the channels 12 are separated from one another with channel-separating portions 14. In other words, the frame portion 38 supports a plurality of channel-separating portions 14 which are arranged in a grid pattern. The channel-separating grid portions 14 separate the channels 12 from one another. As shown in FIG. 6, each channel-separating portion 14 has upper and lower flat surfaces formed with no secondary electron emitting layers. As shown in FIG. 3(*a*), each channel 12 is formed with four through-holes 11 each for performing multiplication of electrons. The through-holes 11 are formed through etching or other means. Each through-hole 11 has a long, rectangular, slit shape. All the multiplication through-holes 11 are elongated in a predetermined direction.

The inner surface of each through-hole 11 is curved and tapered as shown in FIGS. 3(*a*) and 6. Thus, the inner surface of the through-hole 11 is slanted relative to an incidence direction of electrons entering the through-hole 11 from the photocathode 4. The curved and slanted inner surface of the through-hole 11 is formed with a secondary electron emitting layer, on which the electrons entering the through-hole 11 will impinge. The secondary electron emitting layer is formed by secondary emission substance such as antimony (Sb) and alkali metal.

The structure of each through-hole 11 is disclosed in U.S. Pat. No. 5,410,211, the disclosure of which is hereby incorporated by reference.

As also shown in FIGS. 3(*a*) and 6, the through-holes 11 in each channel 12 are separated from one another with a hole-separating portion 13. Each hole-separating portion 13 is in a line shape. The hole-separating portion 13 has upper and lower flat surfaces formed with no secondary electron layers.

Thus, a plurality of (64, in this example) through-holes 11 are formed through each dynode plate 9. The plurality of through-holes 11 are surrounded by the frame portion 38, the channel-separating portions 14, and the hole-separating portions 13.

As shown in FIGS. 2, 3(*a*), and 6, the width of each channel-separating portion 14 is determined dependent on the distance P between the respective anode plates 7. That is, the width of the channel-separating portion 14 is determined almost equal to the distance P. The width of the hole-separating portion 13 is set much smaller than that of the channel-separating portion 14.

Each dynode plate 9 is laid on its adjacent lower dynode plate 9 so that its through-holes 11 are in confrontation with respective through-holes 11 of its lower adjacent dynode plate as shown in FIG. 6. That is, each dynode plate 9 is laid on its adjacent lower dynode plate 9 so that secondary electrons emitted from the inner surface of each through-hole 11 at each dynode plate 9 will properly enter a corresponding through-hole 11 at the corresponding lower adjacent dynode plate 11. Thus, each through-hole 11 at each dynode plate 9 is located at a position where secondary electrons, emitted from the corresponding through-hole 11 at the upper adjacent stage dynode plate 9, reach.

Because the dynode unit 10 has the above-described structure, when electrons are incident on the first stage dynode plate 9*a* at a certain channel 12, the electrons enter one or more of the four through-holes 11 in that channel 12. Those electrons impinge on the slantedly-curved inner surfaces of the through-holes 11, whereupon secondary electrons are emitted from the secondary electron emitting layer formed on the slanted inner surfaces. The secondary electrons are guided by an electric field formed by a potential difference between the first stage dynode plate 9*a* and the second stage dynode plate 9*b*, to thereby fall incident on the second stage dynode plate 9*b* and multiplied there again in the same way as described above.

Thus, the flow of electrons incident on one channel 12 are multiplied by secondary electron emission through the eight stages of dynode plates 9 at the same channel 12. The thus multiplied electrons are then outputted from through-holes 11 in the same channel 12 of a final (eighth) stage dynode plate 9*c*, that is located at the lowermost position of the dynode unit 10. The electrons are then collected at a single anode plate 7 of the same channel. Thus, position-dependent light intensity detection can be performed by the sixteen anode plates 7. That is, the photomultiplier tube 1 can two-dimensionally determine the position where light is incident on the faceplate 3 by determining which anode leads 8 produce the greatest current. Because the current from the anode leads 8 varies dependent on the amount of incident light, the anode leads 8 which output the greatest current will be those directly beneath the position where light is incident on the photomultiplier tube 1.

As apparent from FIG. 6, the photocathode 4 has sixteen effective areas 26, which are positioned in correspondence with the sixteen anodes 7 (sixteen channels 12). Accordingly, the currents from the anode leads 8 from the sixteen anodes 7 indicate the intensity of light incident on the sixteen effective areas 26. It is noted that an ineffective area 25 is provided between each two adjacent effective areas 26. That is, a plurality of ineffective areas 25 are located in correspondence with the channel-separating portions 14 of the dynode unit 10.

With this structure, photoelectrons emitted from each of the effective areas 26 should be properly multiplied through a corresponding channel 12 to be collected at a corresponding anode plate 7. However, photoelectrons emitted from the ineffective area 25 should not be multiplied through any of the sixteen channels 12 so as not to be detected at any anode plates 7.

As shown in FIG. 2, the focusing electrode plate 16 is located below the photocathode 4 and above the dynode unit 10. The focusing electrode plate 16 therefore confronts the first stage dynode plate 9*a*. As shown in FIGS. 2 through 5, the focusing electrode plate 16 has a frame 39. The frame 39 supports a plurality of channel-separating electrodes 20 which are arranged in a grid pattern. The channel-separating grid electrodes 20 are located in correspondence with the grid-shaped channel-separating portions 14 of the dynode unit 10. More specifically, each grid electrode 20 is located just above the corresponding channel-separating portion 14 of the first stage dynode plate 9*a*.

As shown in FIGS. 2 and 4, the grid pattern of the channel-separating electrodes 20 creates sixteen channels 18 therebetween. The sixteen channels 18 are therefore arranged in a four by four matrix in correspondence with the sixteen channels 12 of the dynode plate 9.

Figure 5:
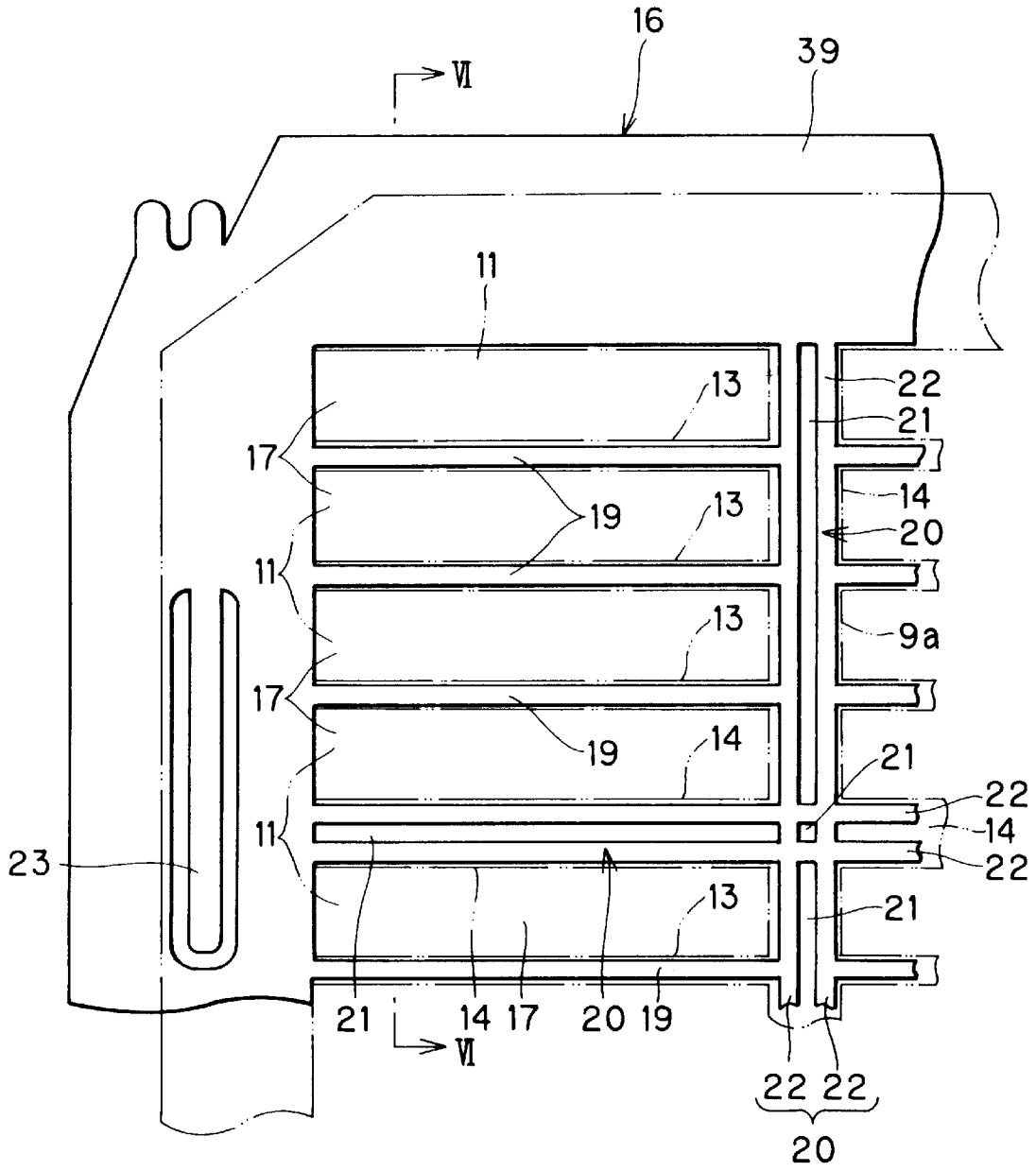
FIG. 5 is a plan view showing the positional relationship between the parts of the focusing electrode plate and the dynode plate.

As shown in FIG. 5, the width of each grid electrode 20 is determined dependent on the width of the channel-separating portion 14. That is, the width of the electrode 20 is set slightly smaller than that of the channel-separating portion 14. Accordingly, the width of the electrode 20 is set slightly smaller than the value P.

As shown in FIG. 5, an opening 21 is formed through each channel-separating electrode grid 20. The opening 21 is formed through an etching or other means. The opening 21 divides the channel-separating electrode grid 20 into a pair of electrode strips 22 which extend parallel to each other and which are separated from each other via the gap 21.

The opening 21 therefore confronts the channel-separating portion 14 of the first dynode plate 9*a* and the ineffective area 25 of the photocathode 4. The width of the opening 21 is smaller than the width of the channel-separating portion 14 of the dynode plate 9. The width of the opening 21 is preferably made as large as possible within the width of the channel-separating electrode 20. In this case, the width of the electrode strips 22 is made as small as possible.

As shown in FIGS. 2 through 5, the focusing electrode plate 16 further has a plurality of electrode strips 19. More specifically, three electrode strips 19 are provided in each channel 18. The three electrode strips 19 divide the channel 18 into four slit openings 17 in correspondence with the four through-holes 11 on the first stage dynode plate 9*a*. In other words, each electrode strip 19 is located in confrontation with a corresponding hole-separating portion 13 on the dynode plate 9*a*. Thus, each slit opening 17 confronts a corresponding through-hole 11 in the first dynode plate 9*a* and a corresponding position in the effective area 26 of the photocathode 4.

The width of each electrode strip 19 is determined dependent on the width of each hole-separating portion 13. That is, the width of the electrode strip 19 is set slightly smaller than the width of the hole-separating portion 13. Because the width of the hole-separating portion 13 is much smaller than that of the channel-separating portion 14, the width of the electrode strip 19 is much smaller than that of the channel-separating electrode 20. It is noted, however, that the width of the electrode strip 19 is almost equal to that of each of the electrode strips 22 which constitute the channel-separating electrode 20.

With this structure, as shown in FIG. 6, each pair of adjacent electrode strips 19 and 19, sandwiching a slit opening 17 therebetween, serve to convergently guide electrons, that are incident on the subject opening 17, into a corresponding through-hole 11 on the first stage dynode plate 9*a*. Similarly, each pair of adjacent electrode strips 19 and 22, that sandwich another slit opening 17 therebetween, also serve to convergently guide electrons, that are incident on the subject opening 17, into a corresponding through-hole 11 on the first stage dynode plate 9*a*. Thus, a pair of adjacent electrode strips 19 and 19 (or 19 and 22), defining each opening 17 therebetween, serve to guide photoelectrons from the photocathode effective area 26 to a corresponding through-hole 11 of the dynode unit 10.

As apparent from FIG. 4, the grid pattern of the electrode strips 19 and 22 sets all the openings 17 to have the equal widths. In other words, the distance between each pair of adjacent strips 19 and 19 and the distance between each pair of adjacent strips 19 and 22 are all set equal to one another. Accordingly, all the openings 17 can provide almost the same amounts of electron lens effect.

Contrarily, each opening 21 is defined between a pair of electrode strips 22. Each opening 21 is located in confrontation with the upper surface of a corresponding channel-separating portion 14 of the first stage dynode plate 9*a*. Thus, the pair of electrode strips 22, sandwiching each opening 21 therebetween, serve to convergently guide electrons, that are incident on the subject opening 21, into the corresponding channel-separating portion 14. Thus, the pair of electrode strips 22, defining each opening 21 therebetween, serve to guide photoelectrons from the photocathode ineffective area 25 to the upper surface of the corresponding channel-separating portion 14.

For example, the photomultiplier tube 1 may be designed as described below with reference to FIGS. 3(*a*) and 3(*b*). In each dynode plate 9, some of the channel-separating portions 14, that extend in a predetermined direction A, have a width W1 of 0.67 mm. Other remaining channel-separating portions 14, that extend in a direction normal to the direction A, have a width W2 of 0.918 mm. Each hole-separating portion 13 has a width W3 of 0.418 mm. The through-holes 11 are arranged in each channel 12 at a pitch D3 of 1 mm. In this case, the focusing electrode plate 16 is designed so that the electrodes 19 and 22 are arranged at a pitch D1 of 1 mm. In the inter-channel gap, the electrode strips 22 and 22 are arranged at a pitch D2 of 0.40 mm. The opening 21 located between the strips 22 and 22 has an amount G of 0.35 mm. Each of the electrode strips 19 and 22 has a width W of 50 $\mu$m.

During manufacture of the photomultiplier tube 1 having the above-described structure, the faceplate 3, with its inner surface being vacuum-deposited with antimony (Sb), is sealingly attached to the upper open end of the square-cylindrical sidewall 2. Then, the electron multiplier assembly 27 is electrically connected to the stem 5 by the pins 8, 15, and 22. An inner surface of each through-hole 11 in each dynode plate 9 is already vacuum deposited with antimony (Sb). Then, the multiplier assembly 27 thus connected with the stem 5 is inserted into the square-cylindrical sidewall 2 through the lower open end. Then, the stem 5 is sealingly attached to the lower open end of the sidewall 2. As a result, the pins 23 on the focusing electrode plate 16 are brought into contact with the inner surface of the faceplate 3.

The tube 6 is then connected to an exhaust system, such as a vacuum pump (not shown), to provide communication between the interior of the photomultiplier tube 1 and the exhaust system. The exhaust system evacuates the envelope 100 via the tube 6. Then, alkali metal vapor is introduced into the envelope 100 through the tube 6. The alkali metal vapor is activated with the antimony on the faceplate 3 to form the photocathode 4. The alkali metal vapor is activated also with the antimony on the inner surface of each through-hole 11 to form the secondary electron emitting layer. The tube 6 is unnecessary after production of the photomultiplier tube 1 is complete, and so is severed at the final stage of producing the photomultiplier tube 1 through a pinch-off seal or the like.

The manufacturing method is described in detail in U.S. Pat. No. 5,504,386, the disclosure of which is hereby incorporated by reference.

The photomultiplier tube 1 having the above-described structure operates as described below.

The focusing electrode plate 16, the dynode unit 10, and the anode plates 7 are supplied with the predetermined electric voltages via the pins 22, 15, and 8. An electric potential distribution is established in the vicinity of the channel-separating electrodes 20 due to the electric potentials developed to the photocathode 4, the focusing electrode plate 16, the dynode plates 9, and the anode plates 7. As indicated by a one-dot-one-chain line of FIG. 6, an electron lens effect occurs in the vicinity of the opening 21 formed to the electrode 20. In more concrete terms, the pair of electrode strips 22 establish the electron lens effect in the opening 21.

Similarly, another electron lens effect occurs in the vicinity of each opening 17. In more concrete terms, at an opening 17 that is defined between each pair of adjacent electrode strips 19 and 19, the pair of electrode strips 19 establish the electron lens effect in the subject opening 17. At another opening 17 that is defined between a pair of adjacent electrode strips 19 and 22, the electrode strips 19 and 22 establish the electron lens effect in the subject opening 17. The electron lens effect thus developed by the electrodes 19 and 22 has almost the same amount with the electron lens effect developed by the electrodes 19 and 19 because the distance between the electrodes 19 and 22 is almost the same as the distance between the electrodes 19 and 19.

When light falls incident on the faceplate 3, the light passes through the faceplate 3 and falls incident on the photocathode 4, which in turn emits photoelectrons.

Some photoelectrons, that are generated at the ineffective area 25 in the photocathode 4, are focused by the electron lens in the opening 21, which is located just below the ineffective area 25. As a result, the photoelectrons are convergently guided through the opening 21 as indicated by the one-dot-one-chain line in FIG. 6. The photoelectrons reach the channel-separating portion 14, of the first stage dynode plate 9*a*, which is located just below the opening 21. The photoelectrons are therefore trapped at the electrically-conductive surface of the channel-separating portion 14. The photoelectrons will be supplied to the electric source (not shown) via the corresponding dynode pin 15 as electric current.

On the other hand, photoelectrons, generated at each position in the effective area 26 of the photocathode 4, are properly focused by an electron lens effect, which is established in the vicinity of an opening 17 that is located just below the electron generating position. The photoelectrons are convergently guided through the opening 17 to enter a through-hole 11 of the first stage dynode plate 9*a* that is located just below the opening 17. The photoelectrons will be multiplied at the multistage dynodes 9 before reaching the corresponding anode plate 7.

It is noted that the width of the opening 21 of the electrode 20 is set smaller than the width of the channel-separating portion 14. Accordingly, photoelectrons generated at an edge of the effective area 26 are not caught by the opening 21. As indicated by a solid arrow in FIG. 6, almost all the photoelectrons generated at the edge of the effective area 26 can be properly focused by the corresponding opening 17 into the corresponding through-hole 11. Uniformity over each anode plate 7 is greatly enhanced.

Figure 7A:
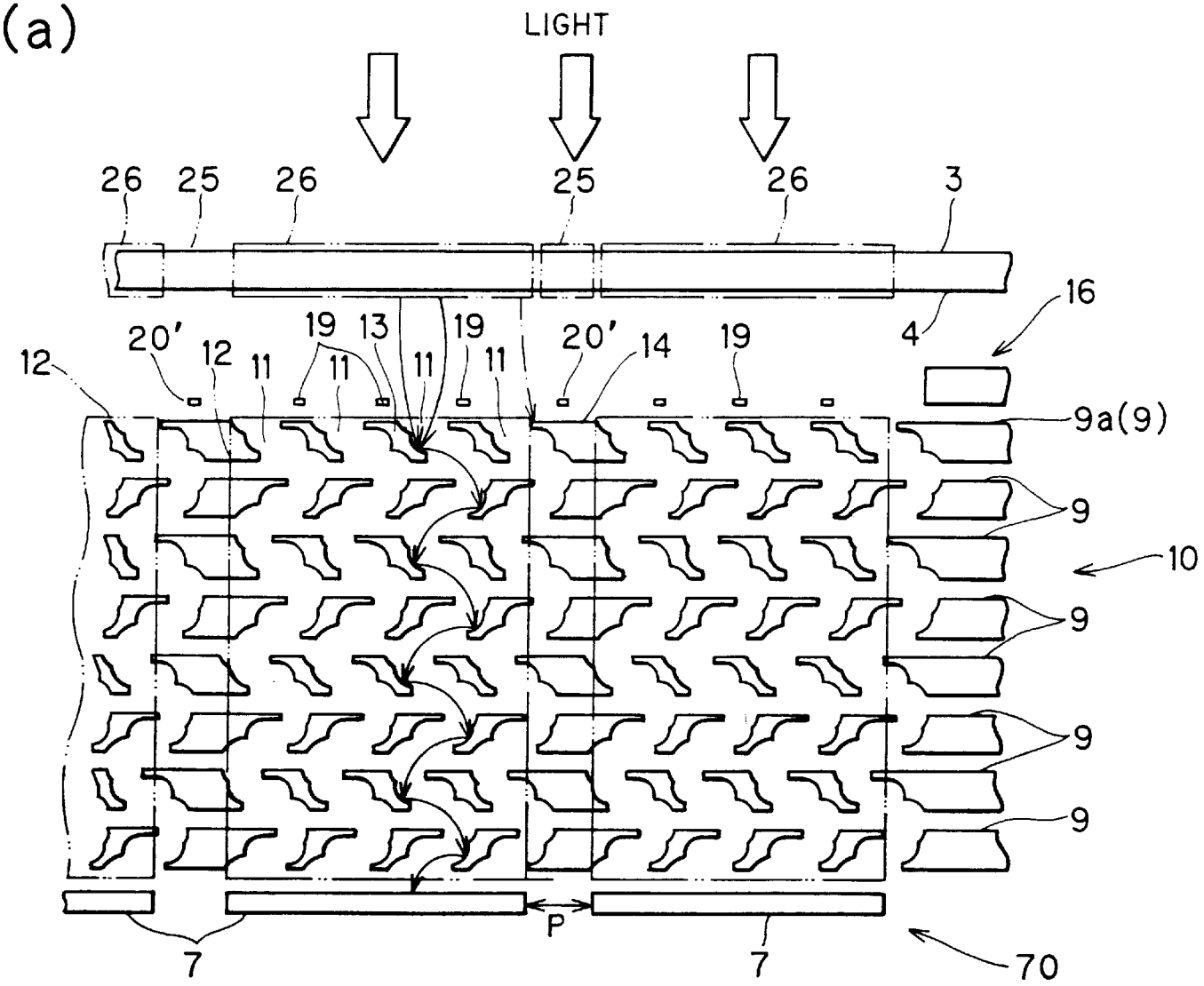
FIGS. 7(*a*) and 7(*b*) are sectional views of comparative photomultiplier tubes of a multianode type.
Figure 7B:
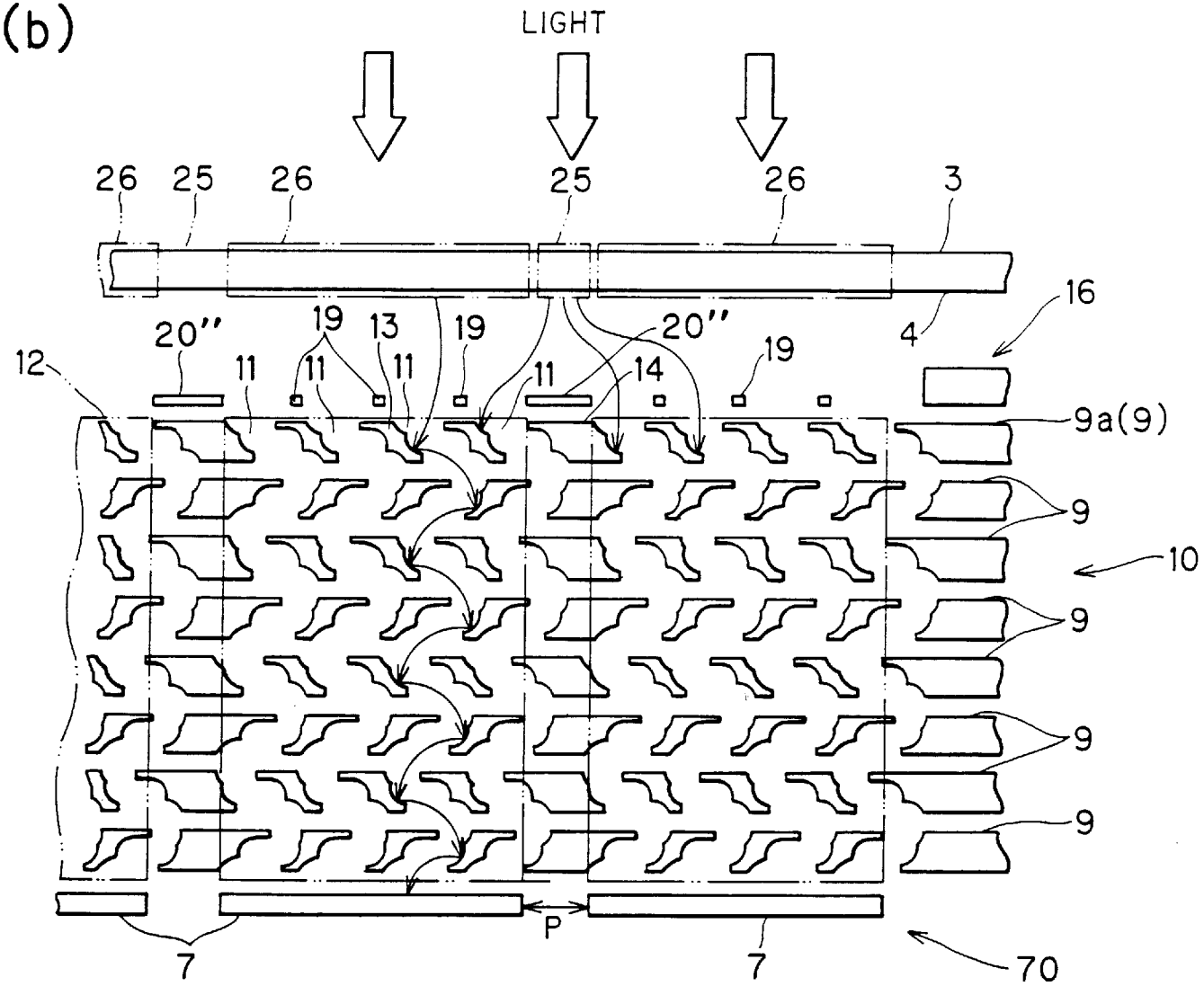

The above-described operation of the photomultiplier tube 1 of the present embodiment will be described below in greater detail with reference to comparative examples shown in FIGS. 7(*a*) and 7(*b*).

In the first comparative example shown in FIG. 7(*a*), the channel-separating grid electrode 20 (which will be referred to as the channel-separating grid electrode 20' hereinafter) is made to have the same thickness with each electrode strip 19. The electrode 20' is formed with no opening. In this case, as apparent from FIG. 7(*a*), the distance between the electrode strips 19 and 20' is much greater than that between the electrode strips 19 and 19. This is because the width of the channel-separating portion 14 is much greater than the width of the hole-separating portion 13.

According to this structure, when light falls incident on the photocathode 3, photoelectrons emitted at substantially the central region of each effective area 26 can be guided by the electric potential distribution (electron lens effect), which is developed between a corresponding pair of adjacent electrodes 19 and 19. Accordingly, in the same manner as in the embodiment of the present invention, those electrons can be properly guided to a corresponding through-hole 11 as indicated by a solid arrow in the figure.

Contrarily, photoelectrons emitted from an edge of each effective area 26, adjacent to the ineffective area 25, will be guided by another electric potential distribution that is developed between a corresponding pair of electrodes 19 and 20'. Because the distance between the electrodes 19 and 20' is too large relative to the distance between the electrodes 19 and 19, the electrodes 19 and 20' fail to produce a sufficient amount of electric lens effect. Accordingly, those photoelectrons emitted from the edge of the effective area 26 will not be properly guided to the corresponding through-hole 11. Those photoelectrons will be partially trapped by the channel-separating portion 14 that is located beneath the electrode 20' as indicated by a one-dot-one chain arrow in the figure.

Thus, some of the photoelectrons, emitted from the edges of each effective area 26, will not be multiplied at the corresponding channel 12, and therefore will not reach the corresponding anode 7. This results in decrease in the total number of photoelectrons detected at each anode. It is impossible to output signals for edges of each channel, thereby deteriorating uniformity over each channel.

According to the other comparative example of FIG. 7(*b*), the width of the channel-separating electrode 20 (which will be referred to as channel-separating electrode 20" hereinafter) is increased. That is, the width of the electrode 20" is set equal to the width P of the channel-separating portion 14. In this case, the distance between the electrode 20" and the adjacent electrode 19 becomes almost equal to the distance between the electrodes 19 and 19. Accordingly, a sufficient amount of electron lens effect is obtained also between the electrodes 19 and 20". Photoelectrons emitted from an edge of the effective area 26 can be properly guided by the electron lens effect to the corresponding through-hole 11 and multiplied therein. It becomes possible to decrease the number of photoelectrons that are trapped by the channel-separating portion 14. It becomes possible to prevent decrease in the total number of photoelectrons detectable at each anode. It is possible to provide signals even for the channel edge portion. Uniformity over each channel is enhanced.

According to this structure, however, the electrode 20" has a great surface area in comparison with the electrodes 19. Accordingly, the electrode 20" distorts the electric potential distribution around the electrode 20". The distorted electric potential distribution largely deflects photoelectrons from the ineffective area 25 and guides the photoelectrons into through-holes 11 of adjacent channels 12. As a result, photoelectrons from the ineffective area 25 will be multiplied and detected at adjacent channel anodes. Photoelectrons even from an effective area 26 of one channel may be largely deflected by the electrode 20" and be guided to through-holes 11 of another channel 12. Crosstalk between respective channels is greatly increased.

Contrarily, according to the present embodiment, as shown in FIG. 6, the opening 21 is formed through the channel-separating electrode 20, and the channel-separating electrode 20 is divided into the pair of thin electrode strips 22. The electrode strips 22 can produce a proper amount of lens effect in the opening 21, thereby properly guiding electrons from the ineffective area 25 to the channel-separating portion 14 of the first state dynode 91. The electrode strips 22 constituting the channel-separating electrode 20 have much smaller areas in comparison with the plate-shaped electrode 20" in the comparative example of FIG. 7(*b*). The electric field developed in the vicinity of the thin electrode strips 22, therefore, does not greatly deflect incident photoelectrons, but develops a proper amount of electron lens effect. Any photoelectrons from the ineffective area 25 are not deflected to be guided to any through-holes 11 of adjacent channels 12. Any photoelectrons from the effective area 26 of one channel are not largely deflected to be guided to any through-holes 11 of another channel. Thus, the number of electrons improperly deflected at the channel-separating electrode 20 decreases. Crosstalk is greatly suppressed.

It is possible to further decrease the number of electrons deflected by the electrode 20 through widening the opening 21 and narrowing the electrode strips 22. It is therefore possible to further suppress the crosstalk.

As described above, according to the present embodiment, the dynode unit 10 is constructed from the plurality of dynodes 9 laminated one on another. Each dynode 9 is formed with multichannels 12 which are separated from one another by the channel-separating portions 14. The focusing electrode plate 16 is formed with multichannels 18 which are separated from one another by the channel-separating electrodes 20 which are located in correspondence with the channel-separating portions 14 of the first stage dynode 9*a*. The plurality of anodes 7 are provided for receiving electrons multiplied at the dynode unit 10 in their corresponding channels 12. Each channel-separating electrode 20 is formed with an opening 21, at a position confronting the channel-separating portion 14 of the first stage dynode 9*a*, for transmitting electrons therethrough. Accordingly, the channel-separating electrode 20 is constructed from a pair of electrode strips 22 which are separated from each other via the gap 21 therebetween. The electrode strips 22 can produce a proper amount of lens effect in the opening 21, thereby properly guiding electrons from the ineffective area 25 to the channel-separating portion 14 of the first state dynode 91. The electrode strips 22 may not deflect those electrons to guide them to any channels 12. The electrode strips 22 may not deflect electrons from the effective area 26 of one channel to through-holes 11 of another channel. Crosstalk can be greatly restrained. Additionally, each electrode strip 22 and an electrode strip 19, that is located adjacent to the electrode strip 22, can produce a proper amount of electron lens effect to properly guide electrons from an edge of the effective area 26 to the corresponding channel 12. Uniformity over each anode 7 can also be greatly enhanced.

While the invention has been described in detail with reference to the specific embodiment thereof, it would be apparent to those skilled in the art that various changes and modifications may be made therein without departing from the spirit of the invention.

For example, the electron multiplier assembly 27 can be used as an electron multiplier when it is not assembled into the envelope 100. In this case, the electron multiplier 27 is used in a vacuum chamber although not shown in the drawings.

It is still possible to suppress the crosstalk and enhance the uniformity over each anode even when the width of the channel-separating electrode 20 is made equal to the width of the channel-separating portion 14 of the dynode 9*a*.

The above description is directed to a type of the electron multiplier assembly 27 employing the multianode unit 70. That is, the electron multiplier assembly 27 is provided with a plurality of anodes 7. However, the electron multiplier assembly 27 can be provided with a single anode. For example, the single anode is constructed from a position sensitive detector (PSD) or the like. Still in this case, it is possible to detect one-dimensional or two-dimensional position of electrons.

In the above-description, each channel 12 is comprised of four through-holes 11. However, each channel 12 may be constructed from a single through-hole 11. That is, each dynode plate 9 is formed with a plurality of through-holes 11 which are separated from one another via the channel-separating portions 14. In this case, the focusing electrode plate 16 is formed with no electrodes 19. The focusing electrode plate 16 may be provided with only the channel-separating electrodes 20 in correspondence with the channel-separating portions 14. Each electrode 20 is formed with an opening 21.

Figure 8:
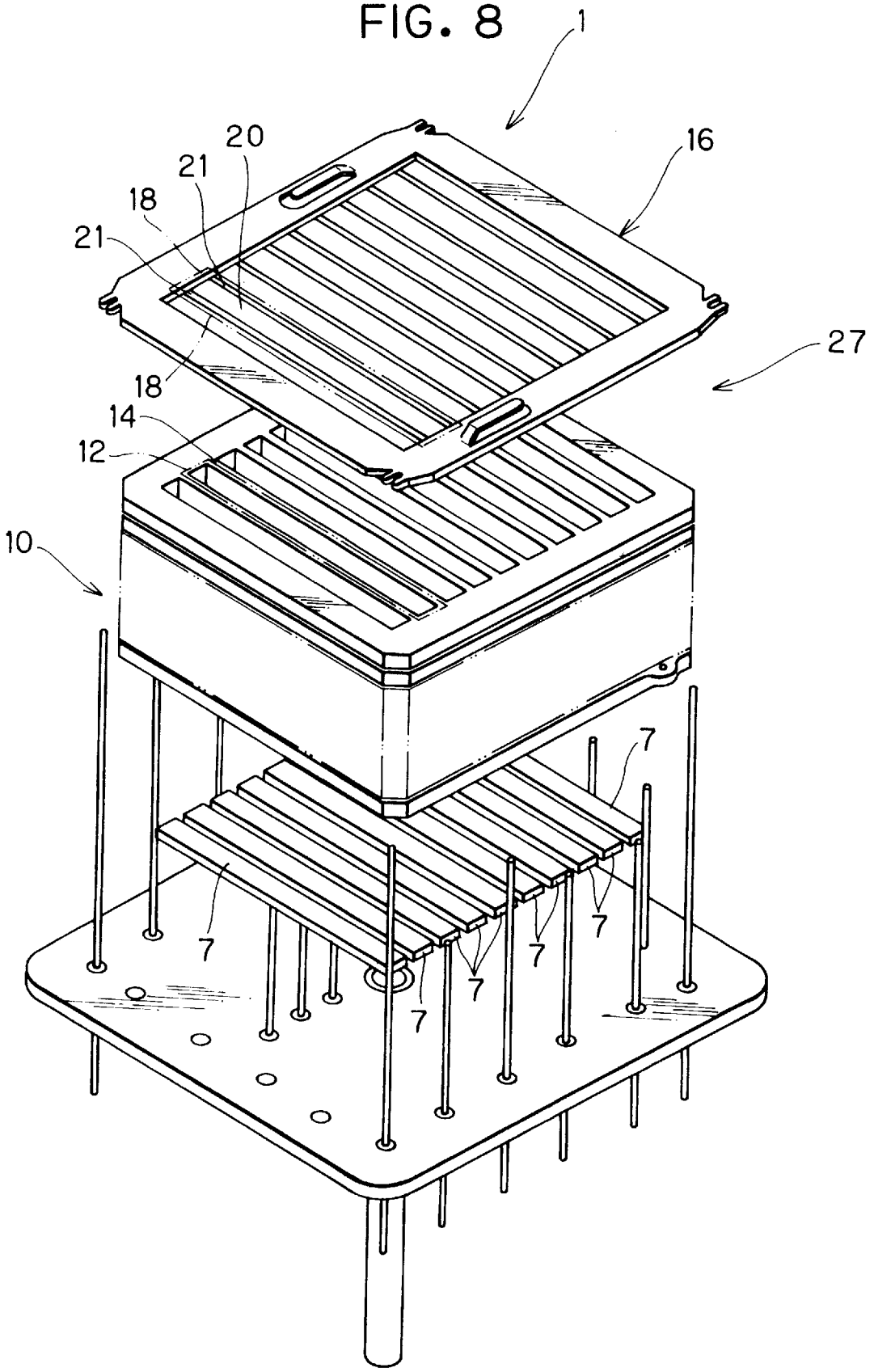
FIG. 8 is an exploded perspective view of a photomultiplier tube of a second embodiment of the present invention.

Additionally, as shown in FIG. 8, the present invention can be applied to an electron multiplier assembly 27 in which a plurality of anodes 7 are arranged in one dimensional array. Each of the anodes 7 has an elongated strip shape. The anodes 7 are arranged linearly in a predetermined direction.

The dynode unit 10 is designed to have a plurality of channels 12 which are arranged in the same direction in which the anodes 7 are arranged. In this modification, each of the channels 12 is constructed from a single through-hole having an elongated slit shape. A channel-separating portion 14 is provided between each adjacent channels 12.

The focusing electrode plate 16 is formed with a plurality of channel openings 18 which are arranged in correspondence with the channels 12 of the dynode unit 10. Thus, the channels 18 are also arranged linearly in the same direction as the anodes 7. Each two adjacent channel openings 18 are separated from each other with a channel-separating electrode 20.

Figure 9:
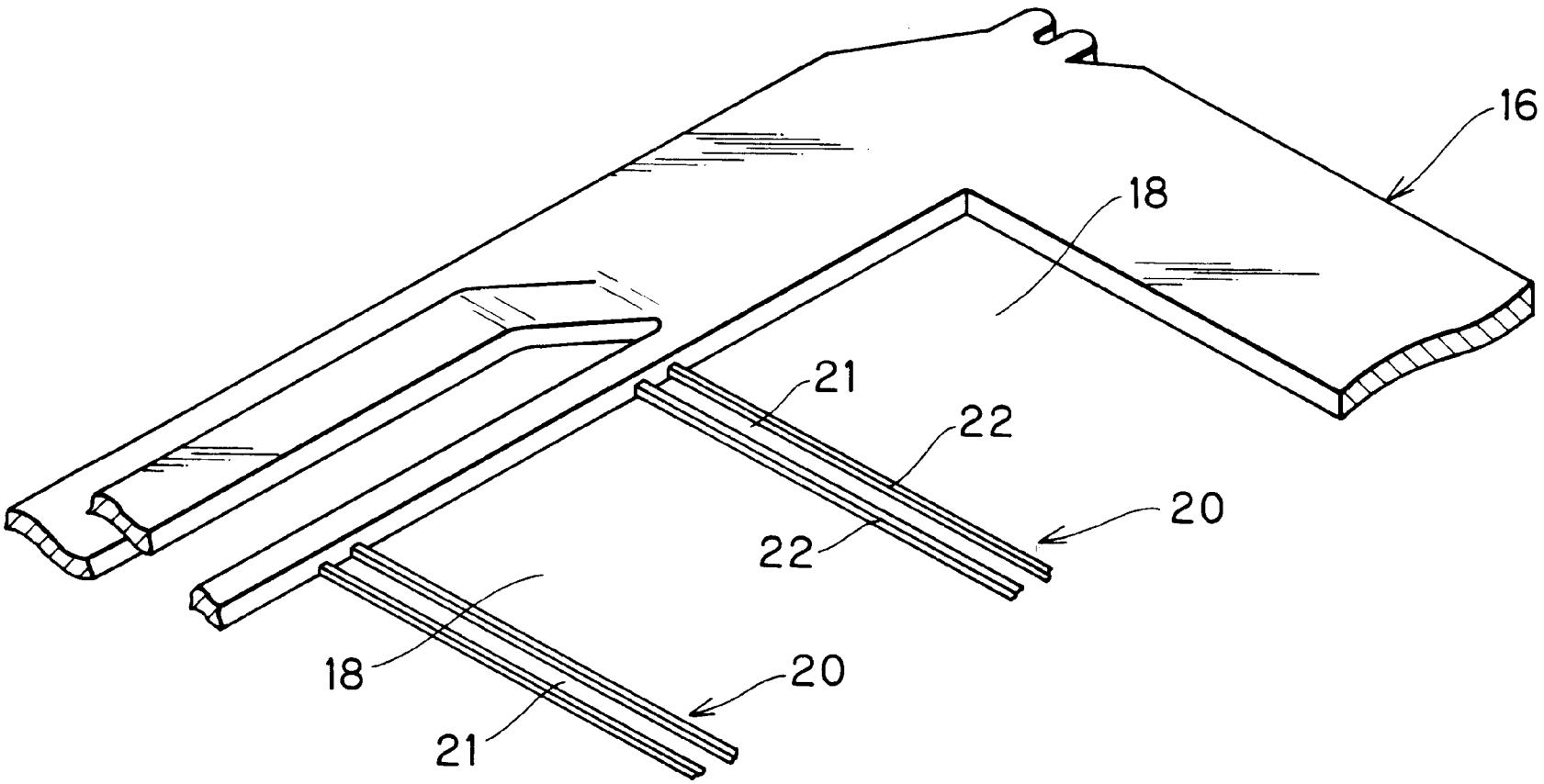
FIG. 9 is an enlarged perspective view of a part of the focusing electrode plate of the second embodiment.

As shown in FIG. 9, an opening 21 is formed through the channel-separating electrode 20. Thus, the channel-separating electrode 20 is constructed from two electrode strips 22 which extend parallel to each other and which are separated from each other via the gap 21. Thus, a plurality of openings 21 are provided in correspondence with the gaps between the anodes 7. The plurality of openings 21 confront the channel-separating portions 14.

When a photomultiplier tube 1 is produced by the electron multiplier 27 of the above-described structure, electrons emitted from the photocathode 4, at positions corresponding to the gaps between the anodes 7, are focused through the openings 21 and are trapped at the channel-separating portions 14. This results in suppression of crosstalk between adjacent anodes 7.

As described above, according to the electron multiplier of the present invention, the channel-separating electrode of the focusing electrode plate is formed with an opening for transmitting electrons therethrough. The opening is located at a position confronting the channel-separating portion of the first dynode. Accordingly, electrons, that fall incident on the channel-separating electrode, are properly focused through the opening by an electron lens effect. The electrons therefore convergently pass through the opening, and are trapped by the channel-separating portion of the first stage dynode. Photoelectrons will not be largely deflected at the channel-separating electrode. Crosstalk between anodes can be suppressed, and the performance of the electron multiplier is greatly enhanced.

What is claimed is:

1. An electron multiplier, comprising:

a dynode unit constructed from a plurality of dynodes laminated one on another, the plurality of dynodes including a first dynode and subsequent dynodes, each dynode having a plurality of channels each for multiplying electrons, the plurality of channels being separated from one another by a channel-separating portion;

a focusing electrode plate located confronting the first dynode and having a plurality of channels each for guiding electrons to a corresponding channel of the first dynode, the plurality of channels being separated from one another by a channel-separating electrode which is located in correspondence with the channel-separating portion of the first dynode, the channel-separating electrode having an opening, at a position confronting the channel-separating portion of the first dynode, for transmitting electrons therethrough and for guiding the electrons to the channel-separating portion of the first dynode; and an anode unit for receiving electrons multiplied at the plurality of channels in the dynode unit.

2. An electron multiplier as claimed in claim 1, wherein the anode unit includes a plurality of anodes each for receiving electrons multiplied at the corresponding channel in the dynode unit.

3. An electron multiplier as claimed in claim 1, wherein a width of the opening formed in the channel-separating electrode is set smaller than a width of the channel-separating portion of the dynode unit.

4. An electron multiplier as claimed in claim 1, wherein each channel of the dynode unit is formed with a plurality of electron multiplication through-holes, and wherein each channel of the focusing electrode plate is formed with a plurality of openings, each of the plurality of openings being positioned confronting the corresponding multiplication through-hole for guiding electrons to the corresponding multiplication through-hole.

5. An electron multiplier as claimed in claim 1, wherein the plurality of electron multiplication through-holes in each channel of the dynode unit are separated from one another with a hole-separating portion, and wherein the plurality of openings in each channel of the focusing electrode plate are separated from one another with a hole-separating electrode, the hole-separating electrode including an electrode positioned confronting the corresponding hole-separating potion.

6. An electron multiplier as claimed in claim 5, wherein the width of the hole-separating electrode is smaller than the width of the channel-separating electrode.

7. An electron multiplier as claimed in claim 1, wherein the plurality of anodes are arranged in a two-dimensional matrix form, and wherein the plurality of channels of the dynode unit are arranged in a two-dimensional matrix form in correspondence with the plurality of anodes.

8. An electron multiplier as claimed in claim 1, wherein the plurality of anodes are arranged in a one-dimensional array, and wherein the plurality of channels of the dynode unit are arranged in a one-dimensional array in correspondence with the plurality of anodes.

9. An electron multiplier as claimed in claim 1, further comprising:

an evacuation sealed envelope for air-tightly sealing the dynode unit, the focusing electrode plate, and the anode unit; and a photocathode provided to the evacuation sealed envelope and confronting the focusing electrode plate.

* * * * *